US007770591B2

(12) United States Patent
Tseng

(10) Patent No.: US 7,770,591 B2
(45) Date of Patent: Aug. 10, 2010

(54) TENT FRAME

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 2 days.

(21) Appl. No.: 12/339,367

(22) Filed: Dec. 19, 2008

(65) Prior Publication Data

US 2010/0154853 A1 Jun. 24, 2010

(51) Int. Cl.
*E04H 15/34* (2006.01)

(52) U.S. Cl. ..... 135/122; 135/123; 135/157; 135/158

(58) Field of Classification Search ..... 135/121, 135/122, 123, 157, 158
See application file for complete search history.

(56) References Cited

U.S. PATENT DOCUMENTS 2,513,729 A * 7/1950 Lemen ..... 135/122
2,799,286 A * 7/1957 Nordmeyer ..... 135/123
3,424,178 A * 1/1969 Yazaki ..... 135/157
4,056,327 A * 11/1977 Daus et al. ..... 403/172
5,730,281 A * 3/1998 Powell et al. ..... 206/223
6,112,756 A * 9/2000 Tseng ..... 135/123
7,275,555 B2 * 10/2007 Powell et al. ..... 135/122
2004/0118443 A1 * 6/2004 Powell et al. ..... 135/122

* cited by examiner

*Primary Examiner*—David Dunn
*Assistant Examiner*—Noah Chandler Hawk
(74) *Attorney, Agent, or Firm*—Ladas & Parry LLP

(57) ABSTRACT

A tent frame includes two main supporting units, a connecting rod unit interconnecting the main supporting units, and two oblique supporting units. Each main supporting unit includes two foot rods, first and second corner connectors mounted respectively on the foot rods, an intermediate connector, a first supporting rod interconnecting the first corner connector and a first rod connecting portion of the intermediate connector, and a second supporting rod interconnecting the second corner connector and a second rod connecting portion of the intermediate connector. Each oblique supporting unit is mounted on a respective one of the main supporting units, and includes a first strut interconnecting the first corner connector and the second rod connecting portion, and a second strut interconnecting the second corner connector and the first rod connecting portion.

5 Claims, 5 Drawing Sheets

TENT FRAME

BACKGROUND OF THE INVENTION

1. Field of the Invention

The invention relates to a tent frame, more particularly to a tent frame that has oblique supporting units for enhancing the structural strength of the tent frame.

2. Description of the Related Art

U.S. Pat. No. 6,112,756 discloses a conventional tent frame 1 as illustrated in FIGS. 1 and 2. The conventional tent frame 1 is adapted for supporting a tent cover 10 thereon, and includes a plurality of spaced-apart main supporting units 11 (only two are shown in FIG. 1), a plurality of connecting rod units 12, each interconnecting an adjacent pair of the main supporting units 11, and a plurality of tensile supporting units 13, each interconnecting an adjacent pair of the main supporting units 11 and spaced apart from a corresponding one of the connecting rod units 12.

Each of the main supporting units 11 includes a pair of spaced apart upright foot rods 111, a pair of first connectors 112 mounted respectively on top ends of the foot rods 111, a second connector 113, and a pair of supporting rods 114. Each of the first connectors 112 has a rod connecting portion 115 that projects toward the second connector 113. The second connector 113 has a pair of rod coupling portions 116 that project respectively toward the first connectors 111. Each of the supporting rods 114 has two ends inserted respectively and removably into the rod connecting portion 115 of a respective one of the first connectors 112 and a corresponding one of the rod coupling portions 116 of the second connector 113, and an intermediate section formed with an aperture 117.

Each of the connecting rod units 12 includes three parallel connecting rods 121, one of the connecting rods 121 being connected between the second connectors 113 of the adjacent pair of the main supporting units 11, while each of the other two of the connecting rods 121 interconnecting two corresponding ones of the first connectors 112 of the adjacent pair of the main supporting units 11.

Each of the tensile supporting units 13 includes a seat 132, a pair of threaded members 133, and a pair of hook members 131. Each seat 132 is formed with threaded holes at opposite ends thereof, screw threads of which extend in opposite directions. The threaded members 133 are connected threadedly and respectively to the threaded holes in the seat 132. Each of the threaded members 133 has an inner end extending threadedly into a respective one of the threaded holes in the seat 132, and an outer end formed with a ring aligned with the aperture 117 of a respective one of the supporting rods 114 of a respective one of the main supporting units 11. Each of the hook members 131 has a hooked outer end extending through the aperture 117 in a respective one of the supporting rods 114 of a respective one of the main supporting units 11, and a hooked inner end hooked to the ring of the outer end of a corresponding one of the threaded members 133. By rotating the seat 132, the threaded members 133 can be threaded in relative to the seat 132 so as to tauten the hook members 131, thereby enhancing the structural strength of the conventional tent frame 1. Therefore, the conventional tent frame 1 is capable of preventing fracture of the tent cover 10 or even collapse of the conventional tent frame 1 due to accumulation of rain or snow.

However, the presence of the apertures 117 in the supporting rods 114 of the main supporting units 11 weakens the structural strength of the supporting rods 114, so that the supporting rods 114 may deform due to accumulation of rain or snow. Since the two ends of each of the supporting rods 114 are inserted removably into the respective one of the first connectors 112 and the corresponding one of the second connectors 113, if too much rain or snow accumulates on the tent cover 10, the deformation of the supporting rods 114 will be serious enough to cause separation of the supporting rods 114 from the first connectors 112 or the second connectors 113, thereby resulting in collapse of the entire conventional tent frame 1.

SUMMARY OF THE INVENTION

Therefore, the object of the present invention is to provide a tent frame having a relatively high structural strength.

Accordingly, a tent frame comprising:

a pair of main supporting units spaced apart from each other in a first horizontal direction, each of the main supporting units including a pair of upright foot rods that are spaced apart from each other in a second horizontal direction transverse to the first horizontal direction, first and second corner connectors that are mounted respectively on top ends of the upright foot rods, each of the first and second corner connectors having a hollow supporting-rod coupling portion, an intermediate connector that is spaced apart from the first and second corner connectors, and that has a hollow first rod connecting portion extending obliquely toward the first corner connector, and a hollow second rod connecting portion extending obliquely toward the second corner connector, a first supporting rod that has opposite first and second end sections inserted respectively into the supporting-rod coupling portion of the first corner connector and the first rod connecting portion of the intermediate connector, and a second supporting rod that has opposite first and second end sections inserted respectively into the supporting-rod coupling portion of the second corner connector and the second rod connecting portion of the intermediate connector;

a connecting rod unit disposed for interconnecting the main supporting units; and a pair of oblique supporting units mounted respectively on the main supporting units, each of which includes first and second struts crossing each other, each of which has opposite first and second strut ends, a first fastening unit for fastening the first strut end of the first strut to the supporting-rod coupling portion of the first corner connector of the respective one of the main supporting units, a second fastening unit for fastening the second strut end of the first strut to the second rod connecting portion of the intermediate connector of the respective one of the main supporting units, a third fastening unit for fastening the second strut end of the second strut to the first rod connecting portion of the intermediate connector of the respective one of the main supporting units, and a fourth fastening unit for fastening the first strut end of the second strut to the supporting-rod coupling portion of the second corner connector of the respective one of the main supporting units.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
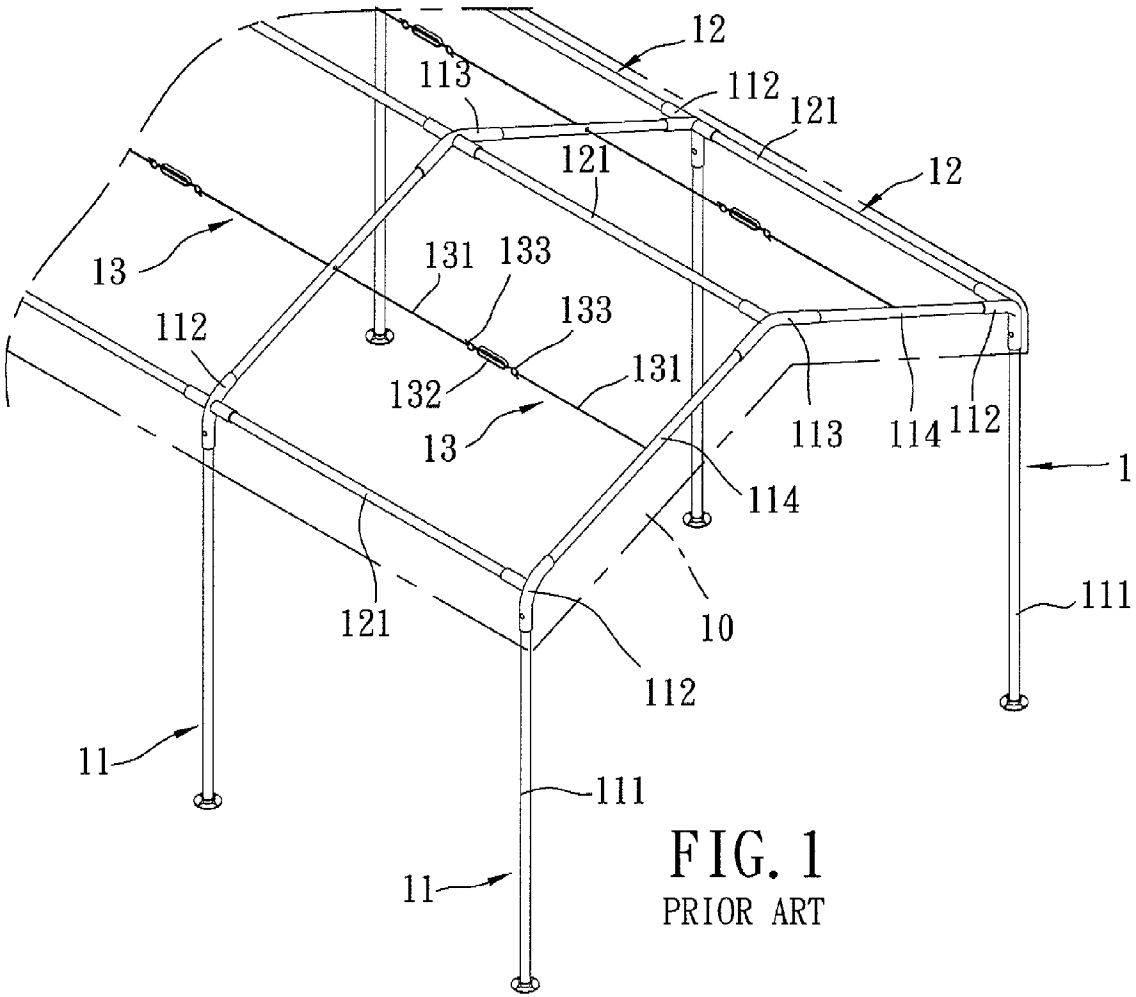
FIG. 1 PRIOR ART
FIG. 1 is a fragmentary perspective view of a conventional tent frame disclosed in U.S. Pat. No. 6,112,756.
Figure 2:
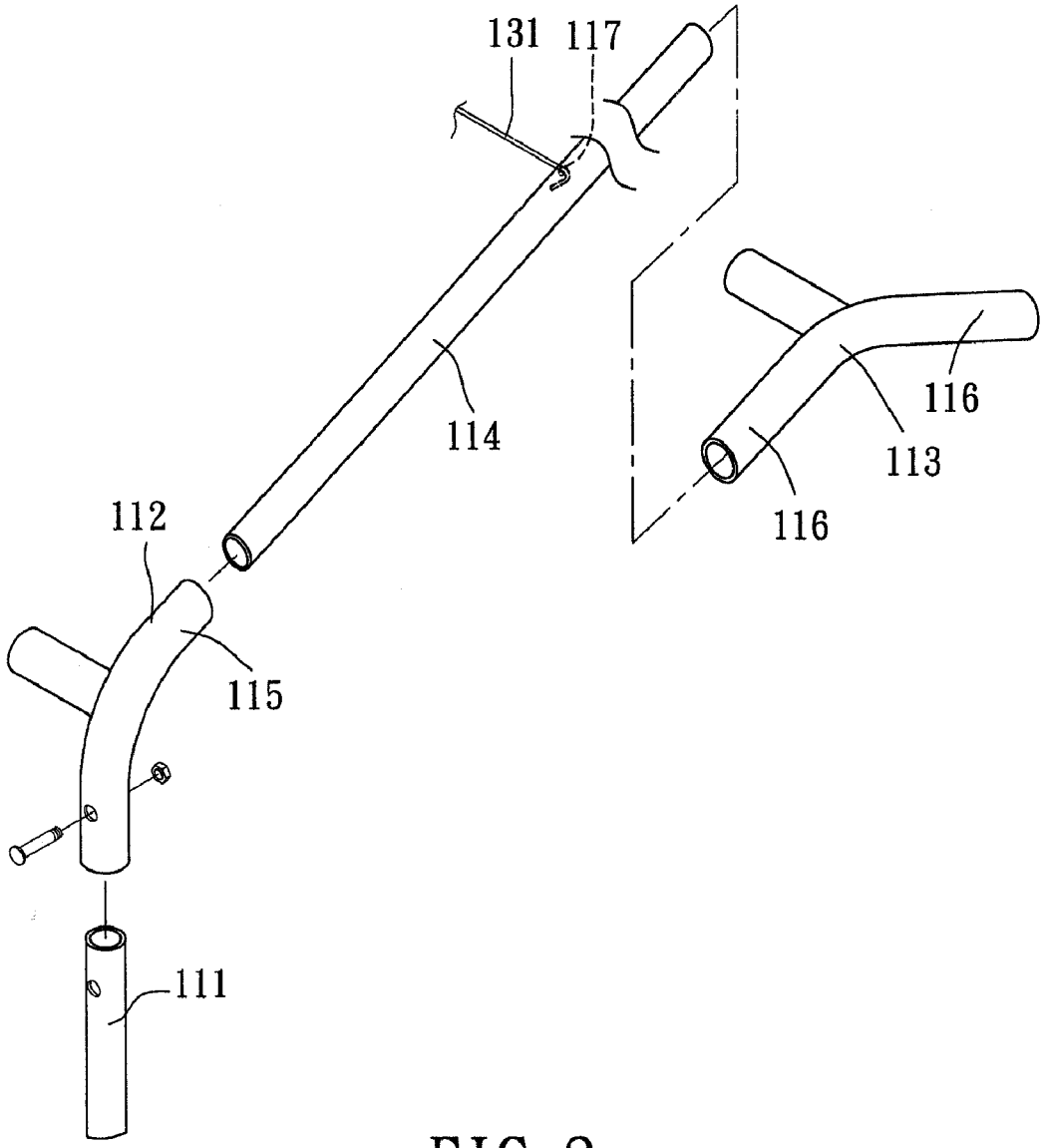
FIG. 2 PRIOR ART
FIG. 2 is a fragmentary exploded perspective view of the conventional tent frame disclosed in U.S. Pat. No. 6,112,756.
Figure 3:
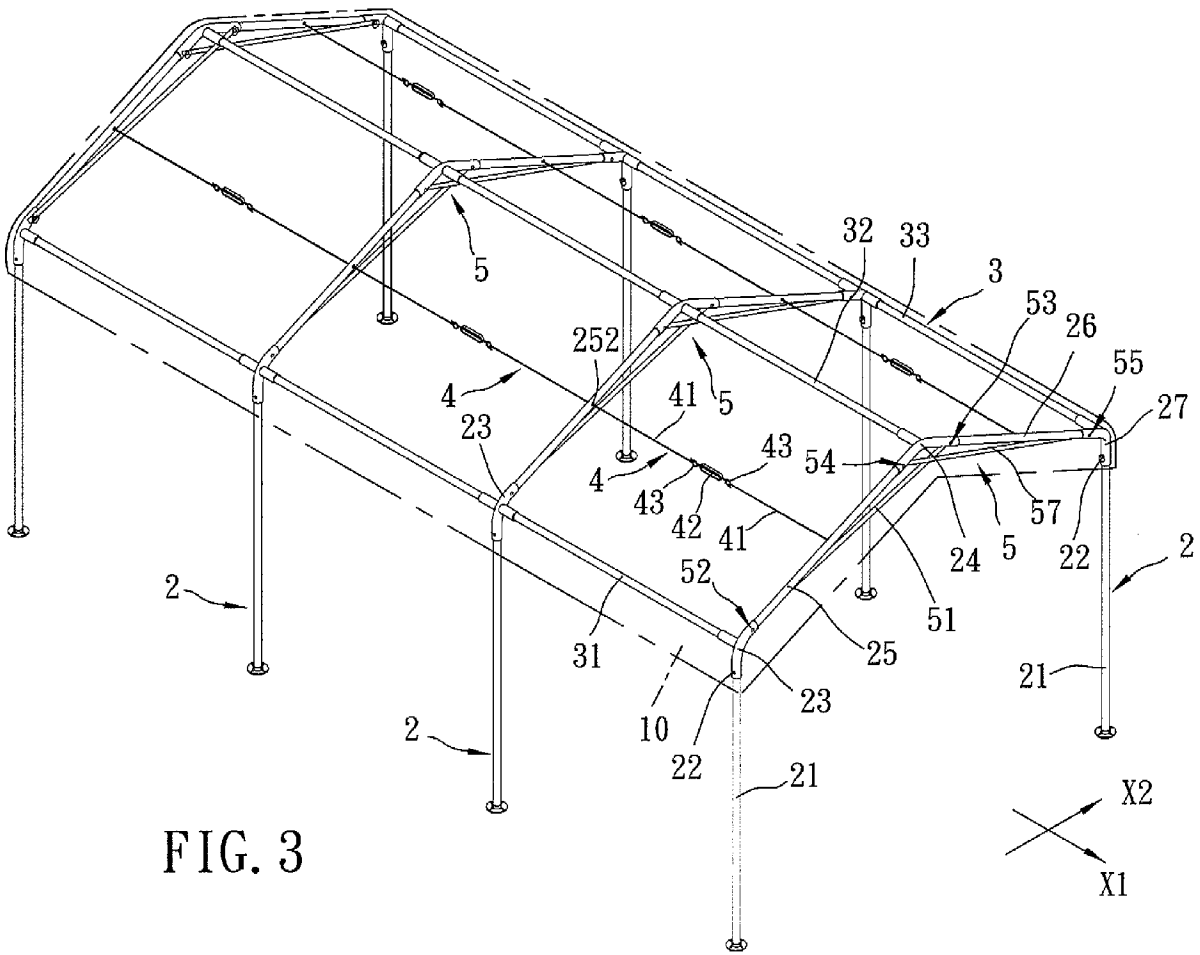
FIG. 3 is an assembled perspective view of a preferred embodiment of a tent frame according to the invention.
Figure 4:
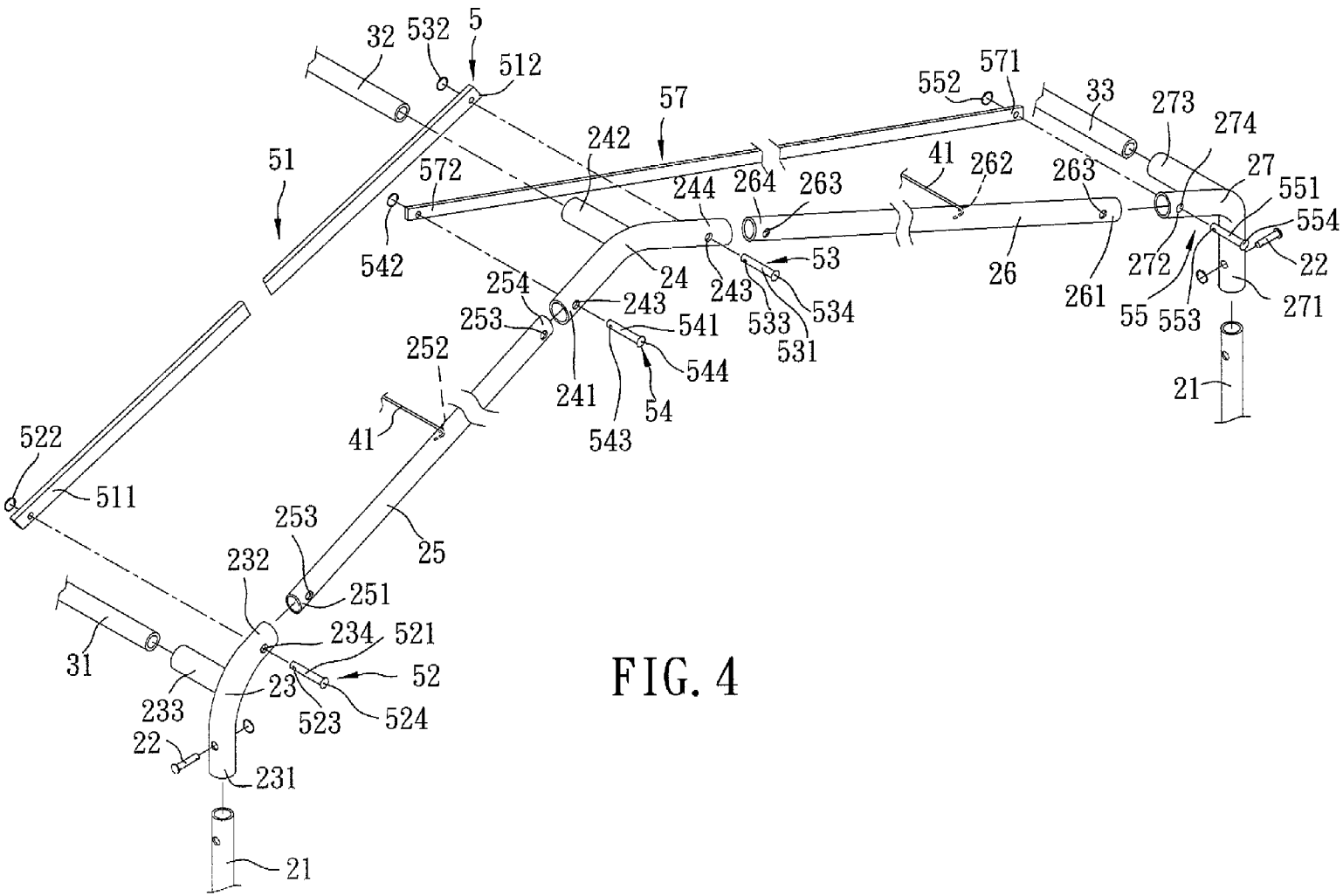
FIG. 4 is a fragmentary exploded perspective view of the preferred embodiment.
Figure 5:
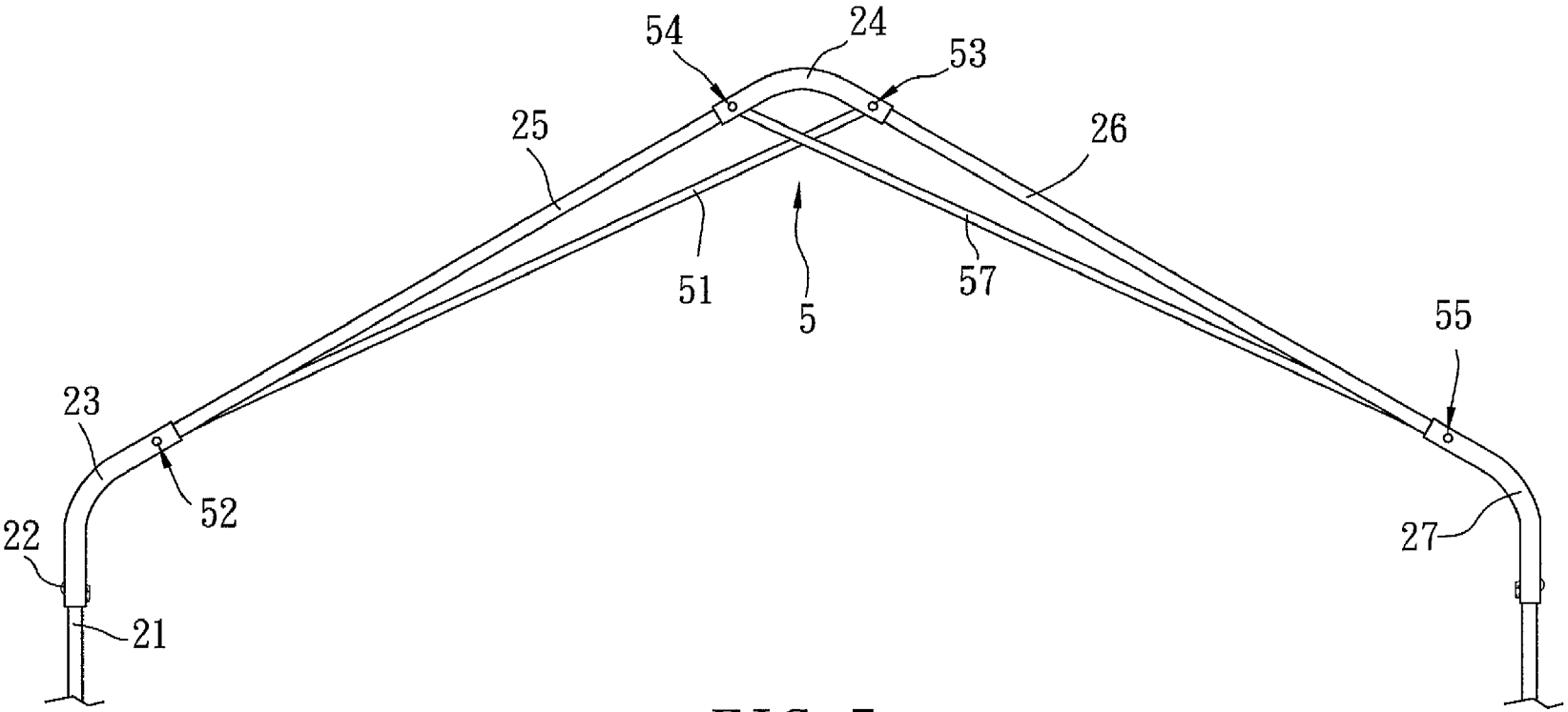
FIG. 5 is a fragmentary side view of the preferred embodiment.

As shown in FIGS. 3 to 5, the preferred embodiment of a tent frame according to the present invention is adapted for supporting a tent cover 10 thereon. In this embodiment, the tent frame comprises a plurality of main supporting units 2, a plurality of connecting rod units 3, a plurality of tensile supporting units 4, and a plurality of oblique supporting units 5.

The main supporting units 2 are spaced apart from each other in a first horizontal direction (X1). Each of the main supporting units 2 includes a pair of upright foot rods 21 that are spaced apart from each other in a second horizontal direction (X2) transverse to the first horizontal direction (X1), first and second corner connectors 23, 27 that are mounted respectively on top ends of the upright foot rods 21, an intermediate connector 24 that is disposed between the first and second connectors 23, 27, and first and second supporting rods 25, 26.

Each of the first and second corner connectors 23, 27 is secured to the top end of the respective one of the upright foot rods 21 by a coupling unit 22. Each of the first and second corner connectors 23, 27 has a hollow vertical coupling portion 231, 271 into which the top end of the respective one of the upright foot rods 21 is inserted, a hollow supporting-rod coupling portion 232, 272 which extends toward the intermediate connector 24 and which is formed with a coupling hole 234, 274, and at least one horizontal rod coupling portion 233, 273 which extends in the first horizontal direction (X1) toward the adjacent one of the main supporting units 2. As such, in this embodiment, each of the first and second corner connectors 23, 27 of the endmost main supporting units 2 of the tent frame is a three-way connector having only one horizontal rod coupling portion 233, 273, while each of the first and second corner connectors 23, 27 of the rest of the main supporting units 2 of the tent frame is a four-way connector having a pair of horizontal rod coupling portions 233, 273 that extend horizontally away from each other.

The intermediate connector 24 is spaced apart from the first and second corner connectors 23, 27, and has a hollow first rod connecting portion 241 extending obliquely toward the first corner connector 23, a hollow second rod connecting portion 244 extending obliquely toward the second corner connector 27, and at least one horizontal rod connecting portion 242. Each of the first and second rod connecting portions 241, 244 is formed with a coupling hole 243. As such, in this embodiment, each of the intermediate connectors 24 of the endmost main supporting units 2 of the tent frame is a three-way connector having only one horizontal rod connecting portion 242 that extends in the first horizontal direction (X1) toward the adjacent one of the main supporting units 2, while each of the intermediate connectors 24 of the rest of the main supporting units 2 of the tent frame is a four-way connector having a pair of horizontal rod connecting portions 242 that extend horizontally away from each other.

The first supporting rod 25 has opposite first and second end sections 251, 254 inserted respectively into the supporting-rod coupling portion 232 of the first corner connector 23 and the first rod connecting portion 241 of the intermediate connector 24, and an intermediate section formed with an engaging hole 252. Each of the first and second end sections 251, 254 of the first supporting rod 25 is formed with a through hole 253. The second supporting rod 26 has opposite first and second end sections 261, 264 inserted respectively into the supporting-rod coupling portion 272 of the second corner connector 27 and the second rod connecting portion 244 of the intermediate connector 24, and an intermediate section formed with an engaging hole 262. Each of the first and second end sections 261, 264 of the second supporting rod 26 is formed with a through hole 263.

The connecting rod units 3 are disposed for interconnecting the main supporting units 2. Each of the connecting rod units 3 includes a first connecting rod 31 that has opposite rod ends inserted respectively into the horizontal rod coupling portions 233 of the first corner connectors 23 of an adjacent pair of the main supporting units 2, a second connecting rod 32 that has opposite rod ends inserted respectively into the horizontal rod connecting portions 242 of the intermediate connectors 24 of the adjacent pair of the main supporting units 2, and a third connecting rod 33 that has opposite rod ends inserted respectively into the horizontal rod connecting portions 273 of the second corner connectors 27 of the adjacent pair of the main supporting units 2.

Each of the tensile supporting units 4 includes a seat 42, a pair of threaded members 43, and a pair of hook members 41. Each seat 132 is formed with threaded holes at opposite ends thereof, screw threads of which extend in opposite directions. The threaded members 43 are connected threadedly and respectively to the threaded holes in the seat 42. Each of the threaded members 43 has an inner end extending threadedly into a respective one of the threaded holes in the seat 42, and an outer end formed with a ring aligned with the engaging hole 252, 262 of a respective one of the first and second supporting rods 25, 26 of a respective one of the main supporting units 2. Each of the hook members 41 has a hooked outer end extending through the engaging hole 252, 262 in a respective one of the first and second supporting rods 25, 26 of a respective one of the main supporting units 2, and a hooked inner end hooked to the ring of the outer end of a corresponding one of the threaded members 43. By rotating the seat 42, the threaded members 43 can be threaded in relative to the seat 42 so as to tauten the hook members 41, thereby enhancing the structural strength of the tent frame of this invention.

The oblique supporting units 5 are mounted respectively on the main supporting units 2. Each of the oblique supporting units 5 includes first and second struts 51, 57 that cross each other. The first strut 51 has opposite first and second strut ends 511, 512. The second strut 57 has opposite first and second strut ends 571, 572. Each of the oblique supporting units 5 further includes a first fastening unit 52 for fastening the first strut end 511 of the first strut 51 to the supporting-rod coupling portion 232 of the first corner connector 23 of the respective one of the main supporting units 2, a second fastening unit 53 for fastening the second strut end 512 of the first strut 51 to the second rod connecting portion 244 of the intermediate connector 24 of the respective one of the main supporting units 2, a third fastening unit 54 for fastening the second strut end 572 of the second strut 57 to the first rod connecting portion 241 of the intermediate connector 24 of the respective one of the main supporting units 2, and a fourth fastening unit 55 for fastening the first strut end 571 of the second strut 57 to the supporting-rod coupling portion 272 of the second corner connector 27 of the respective one of the main supporting units 2.

The first fastening unit 52 includes a first fastening member 521 that has two opposite ends formed respectively with an aperture 523 and an enlarged head 524, and that extends through the coupling hole 234 in the supporting-rod coupling portion 232 of the first corner connector 23 of the respective one of the main supporting units 2, the through hole 253 in the first end section 251 of the first supporting rod 25 of the respective one of the main supporting units 2, and the first strut end 511 of the first strut 51. The first fastening unit 52 further includes a rigid second fastening member 522 extending through the aperture 523 in the first fastening member 521 to confine the corresponding first corner connector 23, the corresponding first supporting rod 25, and the corresponding first strut 51 between the second fastening member 522 and the head 524.

The second fastening unit 53 includes a first fastening member 531 that has two opposite ends formed respectively with an aperture 533 and an enlarged head 534, and that extends through the coupling hole 244 in the second rod connecting portion 244 of the intermediate connector 24 of the respective one of the main supporting units 2, the through hole 263 in the second end section 264 of the second supporting rod 26 of the respective one of the main supporting units 2, and the second strut end 512 of the first strut 51. The second fastening unit 53 further includes a rigid second fastening member 532 extending through the aperture 533 in the first fastening member 531 to confine the corresponding intermediate connector 24, the corresponding second supporting rod 26 and the corresponding first strut 51 between the second fastening member 532 and the head 524.

The third fastening unit 54 includes a first fastening member 541 that has two opposite ends formed respectively with an aperture 543 and an enlarged head 544, and that extends through the coupling hole 243 in the first rod connecting portion 241 of the intermediate connector 24 of the respective one of the main supporting units 2, the through hole 253 in the second end section 254 of the first supporting rod 25 of the respective one of the main supporting units 2, and the second strut end 572 of the second strut 57. The third fastening unit 54 further includes a rigid second fastening member 542 extending through the aperture 543 in the first fastening member 541 to confine the corresponding intermediate connector 24, the corresponding first supporting rod 25 and the corresponding second strut 57 between the second fastening member 542 and the head 544.

The fourth fastening unit 55 includes a first fastening member 551 that has two opposite ends formed respectively with an aperture 553 and an enlarged head 554, and that extends through the coupling hole 274 in the supporting-rod coupling portion 272 of the second corner connector 27 of the respective one of the main supporting units 2, the through hole 263 in the first end section 261 of the second supporting rod 26 of the respective one of the main supporting units 2, and the first strut end 571 of the second strut 57. The fourth fastening unit 55 further includes a rigid second fastening member 552 extending through the aperture 553 in the first fastening member 551 to confine the corresponding second corner connector 27, the corresponding second supporting rod 26 and the corresponding second strut 57 between the second fastening member 552 and the head 554.

In this embodiment, the first fastening member 521, 531, 541, 551 of each of the first, second, third, and fourth fastening units 52, 53, 54, 55 is formed as a pin, while the second fastening member 522, 532, 542, 552 of each of the first, second, third, and fourth fastening units 52, 53, 54, 55 is formed as a ring. However, the shapes of the first fastening members 521, 531, 541, 551 and the second fastening members 522, 532, 542, 552 should not be limited thereto. For example, the first fastening member 521, 531, 541, 551 of each of the first, second, third, and fourth fastening units 52, 53, 54, 55 may be formed as a bolt, while the second fastening member 522, 532, 542, 552 of each of the first, second, third, and fourth fastening units 52, 53, 54, 55 may be formed as a screw nut in other embodiments of this invention.

The presence of the tensile supporting units 4 and the oblique supporting units 5 enhances the structural strength of the main supporting units 2 of the tent frame of this invention. Particularly, the oblique supporting units 5 can reinforce the intermediate section of each of the first and second supporting rods 25, 26 of the main supporting units 2, thereby effectively preventing deformation of the first and second supporting rods 25, 26 of the main supporting units 2. Furthermore, for each of the main supporting units 2, by virtue of the first, second, third, and fourth fastening units 52, 53, 54, 55 of the oblique supporting units 5, the first and second supporting rods 25, 26 of the main supporting units 2 are unable to separate from the intermediate connector 24 and the first and second corner connectors 23, 27 due to deformation of the first and second supporting rods 25, 26 during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A tent frame comprising:

a pair of main supporting units spaced apart from each other in a first horizontal direction, each of said main supporting units including a pair of upright foot rods that are spaced apart from each other in a second horizontal direction transverse to the first horizontal direction, first and second corner connectors that are mounted respectively on top ends of said upright foot rods, each of said first and second corner connectors having a hollow supporting-rod coupling portion, an intermediate connector that is spaced apart from said first and second corner connectors, and that has a hollow first rod connecting portion extending obliquely toward said first corner connector, and a hollow second rod connecting portion extending obliquely toward said second corner connector, a first supporting rod that has opposite first and second end sections inserted respectively into said supporting-rod coupling portion of said first corner connector and said first rod connecting portion of said intermediate connector, and a second supporting rod that has opposite first and second end sections inserted respectively into said supporting-rod coupling portion of said second corner connector and said second rod connecting portion of said intermediate connector;

a connecting rod unit disposed for interconnecting said main supporting units; and a pair of oblique supporting units mounted respectively on said main supporting units, each of which includes first and second struts crossing each other, each of which has opposite first and second strut ends, a first fastening unit for fastening said first strut end of said first strut to said supporting-rod coupling portion of said first corner connector of the respective one of said main supporting units, a second fastening unit for fastening said second strut end of said first strut to said second rod connecting portion of said intermediate connector of the respective one of said main supporting units, a third fastening unit for fastening said second strut end of said second strut to said first rod connecting portion of said intermediate connector of the respective one of said main supporting units, and a fourth fastening unit for fastening said first strut end of said second strut to said supporting-rod coupling portion of said second corner connector of the respective one of said main supporting units.

2. The tent frame as claimed in claim 1, wherein:

said first fastening unit of each of said oblique supporting units extends through said supporting-rod coupling portion of said first corner connector of the respective one of said main supporting units, said first end section of said first supporting rod of the respective one of said main supporting units, and said first strut end of said first strut;

said second fastening unit of each of said oblique supporting units extends through said second rod connecting portion of said intermediate connector of the respective one of said main supporting units, said second end section of said first supporting rod of the respective one of said main supporting units, and said second strut end of said first strut;

said third fastening unit of each of said oblique supporting units extends through said first rod connecting portion of said intermediate connector of the respective one of said main supporting units, said second end section of said second supporting rod of the respective one of said main supporting units, and said second strut end of said second strut; and said fourth fastening unit of each of said oblique supporting units extends through said supporting-rod coupling portion of said second corner connector of the respective one of said main supporting units, said first end section of said second supporting rod of the respective one of said main supporting units, and said first strut end of said second strut.

3. The tent frame as claimed in claim 2, wherein:

said first fastening unit of each of said oblique supporting units includes a first fastening member that extends through said supporting-rod coupling portion of said first corner connector of the respective one of said main supporting units, said first end section of said first supporting rod of the respective one of said main supporting units, and said first strut end of said first strut;

said second fastening unit of each of said oblique supporting units includes a first fastening member that extends through said second rod connecting portion of said intermediate connector of the respective one of said main supporting units, said second end section of said first supporting rod of the respective one of said main supporting units, and said second strut end of said first strut;

said third fastening unit of each of said oblique supporting units includes a first fastening member that extends through said first rod connecting portion of said intermediate connector of the respective one of said main supporting units, said second end section of said second supporting rod of the respective one of said main supporting units, and said second strut end of said second strut; and said fourth fastening unit of each of said oblique supporting units includes a first fastening member that extends through said supporting-rod coupling portion of said second corner connector of the respective one of said main supporting units, said first end section of said second supporting rod of the respective one of said main supporting units, and said first strut end of said second strut.

4. The tent frame as claimed in claim 3, wherein each of said first, second, third, and fourth fastening units of said oblique supporting units further includes a rigid second fastening member coupled to said first fastening member.

5. The tent frame as claimed in claim 4, wherein said first fastening member of each of said first, second, third, and fourth fastening units is formed with an aperture through which said second fastening member extends.

* * * * *